US006080537A

United States Patent [19]

Sugimoto et al.

[11] Patent Number: 6,080,537

[45] Date of Patent: Jun. 27, 2000

[54] SILVER HALIDE EMULSION, PREPARATION METHOD THEREOF AND SILVER HALIDE PHOTOGRAPHIC MATERIAL

[75] Inventors: Hideo Sugimoto; Sadayasu Ishikawa, both of Hino, Japan

[73] Assignee: Konica Corporation, Japan

[21] Appl. No.: 09/299,136

[22] Filed: Apr. 26, 1999

[30] Foreign Application Priority Data

Apr. 28, 1998 [JP] Japan ..... 10-132602

[51] Int. Cl.[7] ..... G03C 1/035; G03C 1/015; G03C 1/09

[52] U.S. Cl. ..... 430/567; 430/569; 430/603

[58] Field of Search ..... 430/567, 569, 430/603

[56] References Cited

U.S. PATENT DOCUMENTS 5,238,796 8/1993 Maruyama et al. ..... 430/505
5,399,471 3/1995 Murai ..... 430/544
5,498,516 3/1996 Kikuchi et al. ..... 430/567
5,807,663 9/1998 Funakubo et al. ..... 430/567

*Primary Examiner*—Mark F. Huff
*Attorney, Agent, or Firm*—Jordan B. Bierman; Bierman, Muserlian and Lucas

[57] ABSTRACT

A silver halide emulsion is disclosed, comprising a dispersing medium and silver halide grains having a variation coefficient of grain size distribution of not more than 20%, at least 50% of total grain projected area of the emulsion being accounted for by tabular grains an aspect ratio of at least 5, the tabular grains each having a surface region having an iodide content more than an average iodide content of the grains, the tabular grains having dislocation lines in a central region and a peripheral region of the major faces, the peripheral region having a silver chalcogenide nucleus-containing phase, the central region having silver nucleus-containing phase, and the peripheral region having at least 10 dislocation lines per grain.

24 Claims, No Drawings

SILVER HALIDE EMULSION, PREPARATION METHOD THEREOF AND SILVER HALIDE PHOTOGRAPHIC MATERIAL

FIELD OF THE INVENTION

The present invention relates to a silver halide emulsion useful in the photographic field and a silver halide light sensitive photographic material by use thereof, and in particular, a silver halide emulsion with enhanced sensitivity and reduced fog and superior in pressure resistance, storage stability, latent image stability, temperature and humidity dependence of latent image variation and a silver halide photographic material by use thereof.

BACKGROUND OF THE INVENTION

Recently, along with the popularity of compact cameras, single-lens reflex cameras and lens-fitted cameras is desired development of a silver halide light sensitive photographic material (hereinafter, also referred to as a photographic material) having high sensitivity and superior image quality. Accordingly, demand for improved performance of silver halide photographic emulsions has become stronger, and a high level demand for photographic performance such as enhanced sensitivity, superior graininess and sharpness have been raised.

In response to the demands, U.S. Pat. Nos. 4,434,226, 4,439,520, 4,414,310, 4,433,048, 4,414,306 and 4,459,353 disclose a technique of using tabular silver halide grains (hereinafter, also simply denoted as tabular grains), thereby leading to advantages, such as enhancement of sensitivity, including enhancement of spectral sensitization efficiency with a sensitizing dye, an improvement of sensitivity/graininess, enhanced sharpness due to the specific optical property of tabular grains and enhanced covering power. However, these are still insufficient response to recent high level demands and still further enhanced performance is desired.

In connection with the trend in enhancement of sensitivity and image quality, the desire for enhanced pressure characteristics of a silver halide photographic material has also increased. Attempts to improve pressure characteristics by various means have been made, and the view that techniques of enhancing stress resistance of silver halide grains is more effective and preferable in practical use rather than technique of using additives such as a plasticizer, is now accepted. In response to such desire, emulsions comprised of core/shell type silver halide grains containing a high iodide silver iodobromide layer have been widely studied. Specifically, a silver iodobromide emulsion comprised of core/shell type grains having an internal phase containing 10 mol % or more iodide has been noted as an emulsion for use in color negative films.

U.S. Pat. No. 4,956,269 discloses a technique of introducing dislocation lines into tabular silver halide grains to enhance the sensitivity of a silver halide emulsion. It is generally known that application of pressure to silver halide grains results in fog formation or desensitization, and dislocation lines-introduced grains exhibit the problem that when subjected to pressure, marked desensitization occurs. JP-A 3-189642 (herein, the term, JP-A means an unexamined published Japanese Patent Application) discloses a monodispersed silver halide emulsion which is accounted for by tabular grains having an aspect ratio of 2 or more and containing 10 or more dislocation lines in fringe portions of the grain. However, such a technique did not improve marked pressure desensitization caused by introduction of dislocation lines.

JP-A 59-99433, 60-35726 and 60-147727, for example, disclose a technique of improving pressure characteristics with core/shell type grains. JP-A 63-220238 and 1-201649 disclose a technique of improving graininess, pressure characteristics and exposure intensity dependence as well as sensitivity. JP-A 6-235988 discloses a technique of enhancing pressure resistance by the use of multiple structure type monodispersed tabular grains having a high iodide intermediate shell.

There have been various factors of non-efficiency relating to the emulsion. As one of such factors is known recombination of a free electron with a positive hole. It has also been known that reduction sensitization is effective to prevent such a recombination described above. U.S. Pat. Nos. 2,487,850 and 2,512,925, and British Patent 789,823 disclose techniques for reduction sensitization. As was reported in Journal of Imaging Science Vol. 29, page 233 (1985), In light of the fact that sensitizing effects by reduction sensitization was rather lower than that of hydrogen sensitization in which a photographic material is treated under a hydrogen atmosphere, as was reported in Journal of Imaging Science Vol. 29, page 233 (1985), it is contemplated that further enhanced effects of reduction sensitization may be feasible.

There have been attempts of not only enhancing sensitivity but also improving other photographic characteristics such as fog, storage stability and latent image keeping. JP-A 1-196136 discloses the use of thiosulfonic acid compounds in combination with reduction sensitization, thereby leading to enhanced sensitivity/fog ratio. JP-A 8-15798 the combined use of a monodispersed silver halide emulsion and reduction sensitization, thereby leading to improvements in sensitivity, fog, graininess and latent image keeping. JP-A 1-127633 discloses a technique of occluding sulfur, selenium or tellurium ions within the grain through the design of halide composition of grains, whereby the sensitivity/fog ratio, pressure resistance and storage stability are improved. Thus, grain designing techniques of employing reduction sensitization in combination with other techniques enable to enhance effects of reduction sensitization and synergistically improve other characteristics.

The exact mechnism of reduction sensitization has not clearly been elucidated as yet. As is reported in Photographische Korrespondenz 1, 20 (1957) and Photographic Science and Engineering 19, 49 (1975), fine silver nuclei formed by reduction sensitization, that is, reduction sensitization nuclei contribute to sensitization through traping positive holes formed upon light absorption of silver halide and releasing electrons. According to Photographic Science and Engineering 16, 35 (1971) and ibid 23, 113 (1979), positive holes have property of trapping not only positive holes but also electrons and therefore the behavior of reduction sensitization nuclei cannot be accounted for only in terms of the positive hole trapping mechanism. Furthermore, in cases when aged under conditions of high temprature and high humidity, the behavior of reduction sensitization nuclei, for example, whether a reaction such as degradation or coagulation occurs or not, has not yet been proved.

Thus, techniques of designing constitution of silver halide grains, including conventional reduction sensitization are not obtained by completely understanding the behavior of the reduction sensitization nuclei and expecting synthetic characteristics of the emulsion, wherein there is clearly room for further improvement.

SUMMARY OF THE INVENTION

An object of the present invention is to provide silver halide emulsions with enhanced sensitivity and reduced fog and superior in pressure resistance, storage stability, latent image stability, temperature and humidity dependence of latent image variation, and silver halide photographic materials by the use theeof.

The object of the present invention is accomplished by the following constitution:

1. a silver halide emulsion comprising a dispersing medium and silver halide grains having a variation coefficient of grain size distribution of not more than 20%, at least 50% of total grain projected area of the emulsion being accounted for by tabular grains having major faces and an aspect ratio of at least 5, the tabular grains each having a surface region having an iodide content more than an average iodide content of the grains, at least 30% by number of the tabular grains having dislocation lines in a central region and a peripheral region of the major faces, the peripheral region having a silver chalcogenide nucleus-containing phase, the central region having silver nucleus-containing phase, and the peripheral region having at least 10 dislocation lines per grain;
2. a method of preparing a silver halide emulsion described in item 1 above, comprising forming nuclear grains by adding a silver salt and a halide salt to a mother liquor, ripening the nuclear grains, and growing the nuclear grains to form final grains by adding a silver salt and a halide salt;
3. a silver halide light sensitive photographic material comprising a support having thereon a silver halide emulsion layer comprising a silver halide emulsion described in item 1 above;
4. a silver halide emulsion comprising a dispersing medium and silver halide grains, a variation coefficient of grain size distribution of total silver halide grains in the emulsion being not more than 20% and at least 50% of the projected area of total grains being accounted for by tabular grains having an aspect ratio of at least 5, wherein the tabular grains has a surface region having an iodide content higher than an average iodide content of the grains; at least 30% by number of the grains having dislocation lines in a central region and a peripheral region of the major faces; the tabular grains having a silver chalcogenide nucleus containing phase in a portion outer than the portion in which the dislocation lines of the peripheral region are introduced, and having a silver nucleus containing phase in a portion inner than the portion in which the dislocation lines of the peripheral region are introduced; and the peripheral region further having at least 10 dislocation lines per grain;
5. a method of preparing a silver halide tabular grain emulsion, wherein reduction sensitization, introduction of dislocation lines and addition of a chalcogenizing are performed in this order during preparation of silver halide grains; and
6. a silver halide light sensitive photographic material comprising a support having thereon a silver halide emulsion layer, wherein the silver halide emulsion layer comprises the silver halide emulsion described in item 4 above.

DETAILED DESCRIPTION OF THE INVENTION

Silver halide grains contained in the silver halide emulsion of the invention are tabular grains. The tabular grains are crystallographically classified as a twinned crystal.

The twinned crystal is a silver halide crystal having one or more twin planes within the grain. Classification of the twinned crystal form is detailed in Klein & Moisar, Photographishe Korrespondenz, Vol.99, p.100, and ibid Vol.100, p.57.

The tabular grains according to the invention are preferably ones having two or more twin planes parallel to the major faces. The twin planes can be observed with a transmission electron microscope, for example, according to the following manner. A coating sample is prepared by coating a silver halide emulsion on a support so that the major faces of tabular silver halide grains are oriented substantially parallel to the support. The sample is cut using a diamond cutter to obtain an approximately. 0.1 $\mu$m thick slice. The twin plane can then be observed with a transmission electron microscope.

The average twin plane spacing is preferably 0.01 to 0.05 pm, and more preferably 0.013 to 0.025 $\mu$m.

The silver halide emulsion used in the invention preferably has a variation coefficient of grain size distribution of total grains contained in the emulsion.

The variation coefficient of grain size distribution is defined as a value calculated from the following equation, using a standard deviation of the distribution of the grain size represented by an equivalent sphere diameter (i.e., standard deviation of grain diameter distribution) and an average value of grain sizes represented by a sphere equivalent diameter (i.e., an average grain diameter):

Variation coefficient of grain size distribution [%]=(Standard deviation of grain diameter distribution)/(Average grain diameter)×100.

The equivalent sphere diameter can be determined according to the following procedure. At least 1,000 grains are extracted at random from an emulsion and photographed under magnification up to 10,000 to 70,000 times by a transmission electron microscope using the replica method. Using an image processing apparatus, the circle equivalent diameter and thickness of the silver halide grains are determined from the electronmicrograph and further converted to a sphere having the same volume. The diameter calculated from the sphere is referred to as an equivalent sphere diameter. The grain thickness can be determined from a shadow length of the replica. The average grain thickness (r) is defined as ri when the product of the frequency (ni) of grain with a thickness (ri) and $ri^3$ (i.e., $ni \times ri^3$) is maximal (with the significant figure being three, and the last digit being rounded off). The variation coefficient of grain size distribution of total silver halide grains is more preferably not more than 16%.

The silver halide emulsion according to the invention comprises tabular grains having an aspect ratio of 5 or more and accounting for at least 50% of the total grain projected area. The aspect ratio is defined as a diameter of a circle having the same area as the projected area of a silver halide grain (equivalent circular diameter), divided by a grain thickness. The expression, accounting for at least 50% of the total grain projeted area means that from observations of transmission electronmicrographs of silver halide grains contained in the emulsion, at least 50% of totalized value of the grain projected area is accounted for. The silver halide emulsion according to the invention is more preferably comprised of tabular grains having an aspect ratio of at least 7 and accounting for at least 60% of total grain projected area, and still more preferably tabular grains having an aspect ratio of at least 9 and accounting for at least 70% of total grain projected area.

In the silver halide emulsion according to the invention, the average grain diameter of the tabular grains, which is represented in terms of an equivalent circular diameter, is preferably 0.1 to 5.0 μm, and more preferably 0.5 to 3.0 μm. The average thickness of the tabular grains is preferably 0.05 to 1.5 mm, and more preferably 0.07 to 0.50 μm. The average thickness is obtained by measuring thicknesses of grains and averaging them.

The silver halide emulsion according to the invention satisfies the requirement that the iodide content in the surface region of the tabular grains is higher than the average iodide content of the grains. The expression "satisfies the requirement that the iodide content in the surface region of the tabular grains is higher than the average iodide content of the grains" does not mean all of the tabular grains satisfying the above-described requirement but means the tabular grains accounting for at least 50% of total grain projected area satisfying the requirement.

Distribution of the iodide content in silver halide grains can be determined by various physical measurements, including measurement of low temperature luminescence, EPMA method and X-ray diffractometry, as described in Abstracts of 1981 Annual Meeting of the Society of Photographic Science and technology of Japan. For example, the average silver iodide content of a silver halide grain group can be determined by the EPMA (or Electron Probe Micro Analyzer) method. Thus, a sample which is prepared by dispersing silver halide grains, which are not in contact with each other, is exposed to electron beams while cooled with liquid nitrogen to not higher than −100° C. Characteristic X-ray intensities of silver and iodine which are radiated from individual grains are measured to determine the silver iodide content of each grain. At least 50 grains are subjected to measurement and their average value is determined.

The surface region of the tabular grains is referred to as the outermost layer of the grain including the outermost surface, to a depth of 50 Å from the outermost surface.

A sample is cooled to −110 to −120° C., exposed to X-rays of Mg-Kα line generated at an X-ray source voltage of 15 kV and an X-ray source current of 40 mA and measured with respect to Ag3d5/2, Br3d and I3d3/2 electrons. From the integrated intensity of a measured peak which has been corrected with a sensitivity factor, the halide composition of the surface can be determined. In the invention, the interior of the grain is referred to as an internal region within the grain at a depth of 50 Å or more from the outermost surface. The tabular grains according to the invention satisfy such a requirement that the iodide content in the surface region is more than the average iodide content of the grains, and the ratio of the iodide content in the surface region to the average iodide content of the grains is preferable from 1.1 to 30, and more preferably from 2.0 to 15.

It is preferred that in the tabular grains according to the invention, distribution of the iodide content among the grains is homogeneous. A variation coefficient of the iodide content distribution represented as below, is preferably not more than 30%, and more preferably, not more than 20%:

Variation coefficiebnt of iodide content distribution (%)=(Standard deviation of iodide content distribution/Average iodide content)×100

The iodide content in the surface region of the tabular grains according to the invention is preferably not less than 1 mol %, more preferably from 2 to 20 mol %, and still more preferably from 3 to 15 mol %.

The dislocation lines are referred to as linear lattice defects forming the boundary between a face slipped on a slipping crystal face and an unslipped face.

The dislocation lines in tabular grains can be directly observed by means of transmission electron microscopy at a low temperature, for example, in accordance with methods described in J. F. Hamilton, Phot. Sci. Eng. 11 57 (1967) and T. Shiozawa, Journal of the Society of Photographic Science and Technology of Japan, 35 213 (1972). Silver halide tabular grains are taken out from an emulsion while ensuring to not exert any pressure to cause dislocation in the grains, and are placed on a mesh for electron microscopy. The sample is observed via transmission electron microscopy, while cooled to prevent the grain from being damaged (e.g., printing-out) by the electron beams. Since electron beam penetration is hampered as the grain thickness increases, sharper observation is obtained when using an electron microscope of a higher voltage (over 200 KV for 0.25 μm thick grains). From the thus-obtained electron micrograph, the position and number of the dislocation lines in each grain viewed perpendicularly to the major face can be determined.

The tabular grains according to the invention, which have two substantially parallel major faces, are comprised of regions, in which one of the regions is a central region and a second of the regions is a peripheral region. The central region and the peripheral region each extend between and form a portion of the major faces.

The tabular grains according to the invention each have dislocation lines in the central region and the peripheral region of the major faces. The central region of the major faces of the tabular grain is a circular area having a radius corresponding to 80% of the radius of a circle having an area equivalent to the major face and having a thickness corresponding to a circular area of the tabular grain when the center is shared between the circular area and the major face, and including the direction of grain thickness. In other words, the central region is an inner portion of 64% or less, based on the volume of the grain. The peripheral region of the major faces is a region, which has an area equivalent to a circular exterior portion of the central region of the major faces, is located in the periphery of the grain and has a thickness equivalent to that of the tabular grain. Herein, the center of the major faces of the tabula grain is defined as the center of gravity on the major face of the grain when the major face is regarded as a two-dimensional figure.

The number of the dislocation lines present in the grain can be measured in the following manner. Electronmicrophotographs are taken with varying the declining angle with respect to the incident electron beam, to confirm the dislocation lines in which the dislocation lines are counted. In cases where the dislocation lines are too close to accurately count the number thereof, a number of dislocation lines are considered to be present in the grain. The dislocation lines located in the central region often form dislocation networks, in which the number of the dislocation lines can not exactly be counted. On the other hand, the dislocation lines located in the peripheral region are observed as lines, which radially extend from the center to the edge and often snake.

In the silver halide emulsion according to the invention, at least 30% by number of the tabular grains have dilocation lines in both of the central region and the peripheral region, having at least 10 dislocation lines per grain in the peripheral region. At least 50% by number of the tabular grains preferably have dilocation lines in both of the central region and the peripheral region, having at least 20 dislocation lines per grain in the peripheral region, and more preferably, at least 70% by number of the tabular grains have dilocation lines in both of the central region and the peripheral region, having at least 30 dislocation lines per grain in the peripheral region.

The introduction of the dislocation lines into the tabular grains can be performed at a prescribed position to form a dislocation as an origin of the dislocation lines, using any of the several well-known methods. Examples of the method for introducing the dislocation lines include addition of an iodide ion containing aqueous solution such as a potassium iodide aqueous solution and a silver salt aqueous solution by the double jet method, addition of an iodide ion solution alone, addition of a fine iodide-containing silver halide grain emulsion, and addition of an iodide ion releasing agent described in JP-A 6-11781. Of these, addition of a fine iodide-containing silver halide grain emulsion, and addition of an iodide ion releasing agent are preferred. Preferably employed as the iodide ion releasing agent are sodium p-iodoacetoamidobenzenesulfonate, 2-iodoethanol or 2-iodoacetoamide.

Silver halide grains according to the invention each have a silver nucleus-containing phase, which are preferably formed through reduction sensitization, in the central region of the major faces. Alternatively, the silver nucleus-containing phase is preferably in a portion inner than the portion in which dislocation lines in the peripheral region are introduced. Further, the silver nucleus-containing phase is preferably located in an inner region of 90% or less, and more preferably 70% or less, based on volume of the central region.

The reduction sensitization is conducted by adding a reducing agent to a silver halide emulsion or a reaction mixture for growing grains. Alternatively, the silver halide emulsion or mixture solution is subjected to ripening or grain growth at a pAg of 7 or less, or at a pH of 7 or more. These methods may be combined. Of these, the method of adding a reducing agent is preferred. Preferred reducing agents include thiourea dioxide, ascorbic acid or its derivatives, and stannous salts. Other preferred reducing agent include borane compounds, hydrazine derivatives, silane compound, amine or polyamine compounds and sulfites. The addition amount thereof is preferably $10^{-8}$ to $10^{-2}$ mol, and more preferably $10^{-6}$ to $10^{-4}$ mol per mol of silver halide. The content of the silver nuclei formed by reduction sensitization is preferably $10^{-8}$ to $10^{-2}$ mol, and more preferably $10^{-6}$ to $10^{-4}$ mol per mol of silver halide.

To conduct ripening at a low pAg, there may be added a silver salt, preferably aqueous soluble silver salt. As the aqueous silver salt is preferably silver nitrate. The pAg in the ripening is 7 or less, preferably 6 or less and more preferably 1 to 3 (herein, pAg=−log [$Ag^+$]). Ripening at a high pH is conducted by adding an alkaline compound to a silver halide emulsion or reaction mixture solution for growing grains. As the alkaline compound are usable sodium hydroxide, potassium hydroxide, sodium carbonate, potassium carbonate and ammonia. In a method in which ammoniacal silver nitrate is added for forming silver halide, an alkaline compound other than ammonia is preferably employed because of lowering an effect of ammonia.

To achieve reductionsensitization, reducing agents, silver salts or alkaline compounds may be added instantaneously or over a period of a given time. In this case, it may be added at a constant rate or accelerated rate. It may be added dividedly in a necessary amount. In this case, it is preferably added separating two or more parts. It may be made present in a reaction vessel prior to the addition of aqueous-soluble silver salt and/or aqueous-soluble halide, or it may be added to an aqueous halide solution to be added. It may be added apart from the aqueous-soluble silver salt and halide.

Silver halide grains according to the invention each have a silver chalcogenide nucleus containing phase, in the peripheral region of the major faces, and preferably in a portion outer than a portion in which dislocation lines present in the peripheral region are introduced. The silver chalcogenide nucleus containing layer is preferably located in an outer region other than an inner region of 110% of the volume of the central region described above, which is not brought into contact with the outermost surface of the grain.

The silver chalcogenide nucleus contained in the silver chalcogenide nucleus containing layer is definitely distinguished from a chalcogenide chemical sensitization nucleus, in a point that it forms a latent image forming center or not. Thus, the silver chalcogenide nucleus is lower in electron trapping capability than the chemical sensitization nucleus. The silver chalcogenide nucleus meeting such requirements can be formed according to a method described later. The silver chalcogenide nucleus containing layer is located preferably in the outside of the dislocation line introducing portion.

The silver chalcogenide nucleus can be formed by adding a compound capable of releasing a chalcogen ion, that is, a chalcogenizing agent. The silver chalcogenide nucleus is preferably a silver sulfide nucleus, silver selenide nucleus and silver telluride nucleus, and more preferably a silver sulfide nucleus. The compound capable of releasing a chalcogen ion is preferably a compound capable of releasing a sulfide ion, a selenide ion or a telluride ion. Preferred examples of the compound capable of releasing a sulfide ion include a thiosulfonic acid compound, a disulfide compound, a thiosulfate, a sulfide, a thiocarbamate compound, thioformaldehyde compound and a rhodanine compound. The compound capable of releasing a selenide ion is preferably a compound known as a selenium sensitizer. Preferred examples thereof include colloidal selenium single body, isoselenocyanates (e.g., allylisoselenocyanate) selenoureas (e.g., N,N-dimethylselenourea, N,N,N-triethylselenourea, N,N,,N-trimethyl-N-heptafluoroselenourea, N,N,N-trimethyl-N-heptafluoropropylcarbonyllselenourea, N,N,N-trimethyl-N-4-nitrophenylcarbonylselenourea), selenoketones (e.g., selenoacetoamide, N,N-dimethylselenobenzamide), selenophosphates (e.g., tri-p-triselenophosphate) and selenides (e.g., diethyl selenide, diethyl diselenide, triethylphosphine selenide). Preferred compounds capable of releasing a telluride ion include telluroureas (e.g., N,N-dimethyltellurourea, tetramethyltellurourea, N-carboxyethyl-N,N-dimethyltellurourea), phosphine tellurides (e.g., tributylphosphine telluride, tricyclohexylphosphine telluride, triisopropylphosphine telluride), telluroamides (e.g., telluroacetoamide, N,N-dimethyltellurobenzamide), telluroketones, telluroesters and isotellurocyanates.

As the chalcogen ion releasing compounds is particularly preferred a thiosulfonic acid compound represented by the following formulas [1] to [3]:

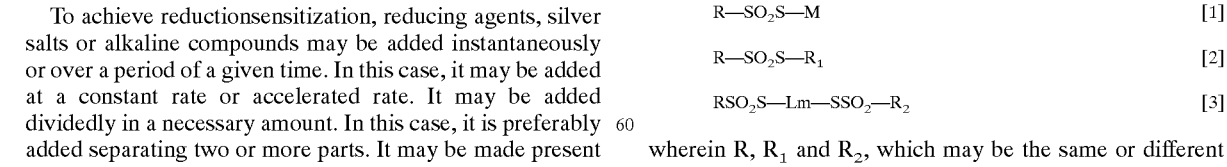

$$R—SO_2S—M \quad [1]$$

$$R—SO_2S—R_1 \quad [2]$$

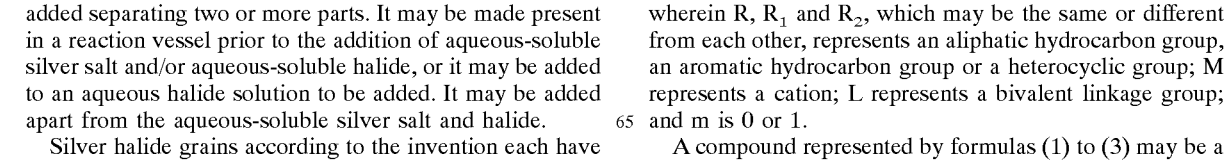

$$RSO_2S—Lm—SSO_2—R_2 \quad [3]$$

wherein R, $R_1$ and $R_2$, which may be the same or different from each other, represents an aliphatic hydrocarbon group, an aromatic hydrocarbon group or a heterocyclic group; M represents a cation; L represents a bivalent linkage group; and m is 0 or 1.

A compound represented by formulas (1) to (3) may be a polymer containing a bivalent repeating unit derived from these structures; and R, $R_1$, $R_2$ an L may be combined with each other to form a ring.

A thiosulfonate compound represented by formulas (1) to (3) will be explained more in detail. In case of R, $R_1$ and $R_2$ being an aliphatic group, they are a saturated or unsaturated, straight or branched, or cyclic aliphatic hydrocarbon group; preferably, an alkyl group having 1 to 22 carbon atoms (e.g., methyl, ethyl, propyl, butyl, pentyl, hexyl, octyl, 2-ethylhexyl, decyl, dodecyl, hexadecyl, octadecyl, cyclohexyl, isopropyl, tobutyl, etc.); an alkenyl group having 2 to 22 carbon atoms (allyl, butenyl, etc.) and an alkynyl group (propargyl, butynyl etc.). These group may be substituted.

In case of R, $R_1$ and $R_2$ being an aromatic group, they include a monocyclic and condensed ring, aromatic groups, preferably those having 6 to 20 carbon atoms such as phenyl. These may be substituted.

In case of R, $R_1$ and $R_2$ being a heterocyclic group, they contain at least one selected from nitrogen, oxygen, sulfur, selenium and tellurium atoms, being each 3 to 15-membered ring (preferably, 3 to 6-membered ring) having at least one carbon atom, such as pyrroridine, piperidine, pyridine, tetrahydrofuran, thiophene, oxazole, thiazole, imidazole, benzothiazole, benzooxazole, benzimidazole, selenazole, benzoselenazole, tetrazole, triazole, benzotriazole, oxadiazole and thiadiazole.

As a substituent for R, $R_1$ and $R_2$, are cited an alkyl group (e.g., methyl, ethyl, hexyl etc.), alkoxy group (e.g., methoxy, ethoxy, octyloxy, etc.), aryl group (e.g., phenyl, naphthyl, tolyl etc.), hydroxy group, halogen atom (e.g., fuorine, chlorine, bromine, iodine), aryloxy group (e.g., pheoxy), alkylthio (e.g., methythio, butylthio), arylthio group (e.g., phenylthio), acyl group (e.g., acetyl, propinyl, butylyl, valeryl etc.), sulfonyl group (e.g., methysulfonyl, phenylsulfonyl), acylamino group (e.g., acetylamino, benzoylamino), sulfonylamino group (e.g., methanesulfonylamino, benzenesulfonylamino, etc.), acyoxy group (e.g., acetoxy, benzoxy, etc.), carboxy group, cyano group, sulfo group, amino group. —$SO_2SM$ group (M is a monovalent cation) and —$SO_2R_1$.

A bivalent linking group represented by L is an atom selected from C, N, S and 0 or an atomic group containing at least one of them. Examples thereof are an alkylene group, alkenylene group, alkynylene group, arylene group, —O—, —S—, —NH—, —CO— or —$SO_2$—, or a combination thereof.

L is preferably a bivalent aliphatic or aromtic group. Examples of the aliphatic group include

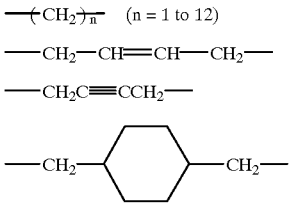

and xylylene group. As the aromatic group, are cited phenylene group and naphthylene group.

These groups may have a substituent as afore-described.

M is preferably a metallic ion or organic cation. As the metallic ion are cited lithium ion, sodium ion and potassium ion. As the organic cation are cited an ammonium ion (e.g., ammonium, tetramethyammonium, tetrabutylammonium, etc.), phosphonium ion (e.g., tetraphenylphosphonium) and guanidyl group.

In the case where a compound represented by formulas [1] to [3] is a polymer, a repeating unit thereof is as follows. These polymer may be a homopolymer or copolymer with other copolymerizing monomers.

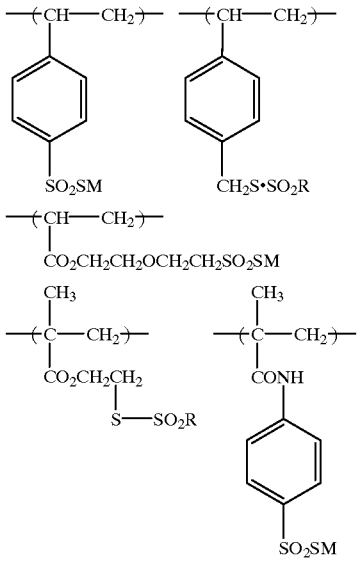

Examples of the compounds represented by formulas [1] to [3] are described in JP-A 54-1019, British Patent No. 972,211 and Journal of Organic Chemistry vol.53, page 396 (1988).

The chalcogen ion releasing compound is added to form the silver chalcogenide nucleus, in an amount of $10^{-8}$ to $10^{-2}$ mol, and more preferably $10^{-6}$ to $10^{-3}$ mol per mol of silver halide. The silver chalcogenide nucleus is contained preferably in an amount of $10^{-8}$ to $10^{-2}$ mol, and more preferably $10^{-6}$ to $10^{-4}$ mol per mol of silver halide. The chalcogen ion releasing compound may be added instantaneously or over a period of time. The compound may be added at a constant flow rate or a variable flow rate. The compound may separately be added. Formation of the silver chalcogenide nucleus must be completed before completing grain growth. A silver chalcogenide nucleus formed after completion of the grain growth, which is incorporated as a part of chemical sensitization nuclei formed in the chemical sensitization process, does not substantially contribute to effect of the present invention. Similarly, in cases when internally chemical-sensitized, a silver chalcogenide nucleus formed on the same face as in chemical sensitization, does not substantially contribute to effect of the present invention.

The tabular grains according to the invention may be grains forming latent images mainly on the grain surface or ones forming latent images mainly in the grain interior.

The tabular grains are prepared in the presence of a dispersing medium, i.e., in an aqueous solution containing a dispersing medium. The aqueous solution containing a dispersing medium is an aqueous solution in which a protective colloid is formed with gelatin or other compounds capable of forming a hydrophilic colloid (or materials capable forming a binder), and preferably an aqueous solution containing a colloidal protective gelatin. Gelatins used as a protective colloid include alkali-processed gelatin and acid processed gelatin. Preparation of the gelatin is detailed in A. Veis, "The Macromolecular Chemistry of Gelatin", Academic Press (1964). Examples of hydrophilic colloids usable as a protective colloid other than gelatin include gelatin derivatives; graft polymers of gelatin and other polymers; proteins such as albumin and casein; cellulose derivatives such as hydroxyethylcellulose, carboxymethylcellulose and cellulose sulfuric acid ester; saccharine derivatives such as sodium alginate and starch derivatives; and synthetic hydrophilic polymeric materials such as homopolymers or copolymers of polyvinyl alcohol, polyvinyl alcohol partial acetal, poly-N-vinyl pyrrolidone, polyacrylic acid, polymethacrylic acid, polyacryl amide, polyvinyl imidazole, and polyvinyl pyrazole. There is preferably employed gelatin having a jelly strength of at least 200, as defined in the PAGI method.

The tabular grains according to the invention can contain a metal element in the interior or exterior of the grain by incorporating at least one selected from a cadmium salt, a zinc salt, a thallium salt, an iron salt, a rhodium salt, an iridium salt, an indium salt and their complex salts the stage of nucleation and/or grain growth.

Means for forming the tabular grains according to the invention include a variety of methods known in the art. Thus, single jet addition, controlled double jet addition and controlled triple jet addition can be employed individually or in combination. To obtain highly monodispersed grains, it is important to control the pAg in the grain forming liquid phase, so as to fit the growth rate of silver halide grains. The pAg is to be in the range of 7.0 to 11.5, preferably 7.5 to 11.0, and more preferably 8.0 to 10.5. The flow rate can be selected by referring to JP-A 54-48521 and 58-49938.

The process of preparing silver halide emulsions used in the invention is mainly comprised of nucleation stage and ripening stage, followed by growth stage. Alternatively, it is possible to allow a preformed nucleus grain emulsion (or seed emulsion) to be grown. The growth stage may further be separated into a few steps, such as a first growth step, a second growth step, etc. The growth stage is referred to as all of the growth stage from after forming nucleus grains (or seed grains) to completion of grain growth, and the start of growth means the starting point of the growth stage.

In preparation of silver halide emulsions used in the invention, solvents for silver halide known in the art may be present, including ammonia, thioethers and thioureas.

To introduce the dislocation lines preferentially into the central region of the major faces, it is important it is important to increase the pH in the ripening stage after nucleation, allowing nucleus grains to be ripened to increase the thickness of tabular grains. When the pH is too high, the aspect ratio of the grains is lowered and it becomes hard to control to enhance the aspect ratio in the growth stage. Furthermore, unexpected fogging may occur. Therefore, the pH/Temperture at the ripening stage is preferably 7.0 to 11.0 and 40 to 80° C., respectively, and more preferably 8.5 to 10.0 and 50 to 70° C.

To introduce the dislocation lines preferentially in the peripheral region, it is important to increase the pAg after adding, to the substrate grains, an iodide ion source for introducing the dislocation lines (e.g., fine silver iodide grains, or an iodide ion releasing agent). However, when the pAg is excessively increased, so-called Ostwald ripening proceeds concurrently with grain growth, resulting in deterioration in monodispersity of the tabular grains. Accordingly, when forming the peripheral region of the tabular grains at the stage of grain growth, the pAg is preferably 8 to 12, and more preferably 9.5 to 11. In cases where the iodide ion releasing agent is used as an iodide ion source, the dislocation lines can effectively be formed by acceleratedly adding the agent. Preferred examples of the iodide ion releasing agent include a p-iodoacetoamidobenzenesulfonate, 2-iodoethanol and 2-iodoacetoamide. The iodide ion releasing agent is preferably added in an amount of 0.5 mol or more, and more preferably 2 to 5 mol per mol of silver halide.

After completing the grain growth, silver halide emulsions used in the invention may be subjected to desalting to remove soluble salts, after completing the grain growth. The emulsions can also be desalted during grain growth, as described in JP-A 60-138538. Desalting can be conducted according to the method described in Research Disclosure (hereinafter, also denoted as RD) 17643, Section II. More specifically, to remove soluble salts from the emulsion after forming precipitates or completing physical ripening are preferably employed the noodle washing method by gelling gelatin and the flocculation method using inorganic salts, anionic surfactants (e.g., polystylenesulfonate) or gelatin derivatives (e.g., acylated gelatin, carbamoyl-modified gelatin). Exemplarily, the method decribed in JP-A 5-72658 is preferably employed.

The emulsion according to the invention can be chemically sensitized according to the conventional method. Sulfur sensitization, selenium sensitization and a gold sensitization by use of gold or other noble metal compounds can be employed singly or in combination. The emulsion can be spectrally sensitized to a wanted wavelength region by use of sensitizing dyes known in the art. The sensitizing dye can be employed singly or in combination thereof. There may be incorporated, with the sensitizing dye, a dye having no spectral sensitizing ability or a supersensitizer which does not substantially absorb visible light and enhances sensitization of the dye.

An antifoggant and stabilizer can be added into the tabular grain emulsion. Gelatin is preferably employed as a binder. An emulsion layer or other hydrophilic colloid layers can be hardened with hardeners. A plasticizer or a dispersion of a water-soluble or water-insoluble polymer (so-called latex) can be incorporated.

In a silver halide emulsion layer of the color photographic material, a coupler can be employed. There can also be employed a competing coupler having an effect of color correction and a compound which, upon coupling reaction with an oxidation product of a developing agent, is capable of releasing a photographically useful fragment, such as a developing accelerator, a developing agent, a silver halide solvent, a toning agent, hardener, a fogging agent, a chemical sensitizer, a spectral sensitizer and a desensitizer.

A filter layer, anti-halation layer or anti-irradiation layer can be provided in the photographic material relating to the invention. In these layers and/or an emulsion layer, a dye which is leachable from a processed photographic material or bleachable during processing, can be incorporated. Furthermore, a matting agent, lubricant, image stabilizer, formalin scavenger, UV absorbent, brightening agent, surfactant, development accelerator or development retarder is also incorporated into the photographic material. Employed may be, as a support, polyethylene-laminated paper, polyethylene terephthalate film, baryta paper or cellulose triacetate film.

EXAMPLES

Embodiments of the present invention will be further explained, based on examples but the invention is not limited to these examples.

Example 1

Preparation of Emulsion EM-1 (Inventive)

Nucleation Stage

The following reaction mother liquor (Gr-1) contained in a reaction vessel was maintained at 30° C. and adjusted to a pH of 1.96 with a 1N sulfuric acid aqueous solution, while stirring at a rotation speed of 400 r.p.m. with a stirring mixer apparatus described in JP-A 62-160128. Thereafter, solutions (S-1) and (H-1) are each added by the double jet addition at a constant flow rate for a period of 1 min. to form nucleus grains.

| | | |
|---|---|---|
| (Gr1) | | |
| Alkali-processed gelatin (average molecular weight of 100,000) | 25.50 | g |
| Potassium bromide | 7.80 | g |
| Distilled water to make | 10.2 | l |
| (S-1) | | |
| Silver nitrate | 543.0 | g |
| Distilled water to make | 2.56 | l |
| (H-1) | | |
| Potassium bromide | 380.6 | g |
| Distilled water to make | 2.56 | l |

Ripening Stage

After completing the above nucleation stage, solution (G-1) was added thereto and the temperature was raised to 60° C. in 30 min., while the silver potential of the emulsion within the reaction vessel (which was measured with a silver ion selection electrode using a saturated silver-silver chloride electrode, as a reference electrode) was controlled at 6 mV. Subsequently, the pH was adjusted to 9.3 with an aqueous ammonia solution and after maintained for 7 min., the pH was adjusted to 6.1 with an acetic acid aqueous solution, while the silver potential was maintained at 6 mV with an aqueous 2N potassium bromide solution.

| | | |
|---|---|---|
| (G-1) | | |
| Alkali-processed gelatin (average molecular weight of 100,000) | 109.5 | g |
| $HO(CH_2CH_2O)m(CH(CH_3)CH_2O)_{19.8}(CH_2CH_2O)nH$ (m + n = 9.77, Compound EO) 10% ethanol solution | 3.66 | ml |
| Distilled water to make | 2.66 | l |

Growth Stage

After completing the ripening stage, solutions (S-1) and (H-1) described above were added by the double jet addition at an accelerated flow rate (12 times faster at the end than at the start) for a period of 37 min. After completing addition, solution (R-1) was instantaneously added, followed by addition of solution (G-2) and the stirring speed was adjusted to 550 r.p.m., then, solution (S-2) and solution (H-2) were added by the double jet addition at an accelerated flow rate (1.4 times faster at the end than at the start) for a period of 20 min., while the silver potential of the emulsion was maintained at 6 mV with an aqueous 2N potassium bromide solution. After completing addition, the silver potential was adjusted to −39 mV with an aqueous 3N potassium bromide solution. Subsequently, after adding solution (F-1) of 1097.1 g, solution (S-2) and (H-2) were added by the double jet addition at an accelerated flow rate (1.5 times faster at the end than at the start) for a period of 54 min. During addition, when the remaining amount of solution (s-2) reached 1.50 l, solution (T-1) was instantaneously added.

| | | |
|---|---|---|
| (S-2) | | |
| Silver nitrate | 2.35 | kg |
| Distilled water to make | 3.96 | l |
| (H-2) | | |
| Potassium bromide | 1.65 | kg |
| Distilled water to make | 3.96 | l |
| (G-2) | | |
| Ossein gelatin | 179.4 | g |
| $HO(CH_2CH_2O)m(CH(CH_3)CH_2O)_{19.8}(CH_2CH_2O)nH$ (m + n = 9.77, Compound EO) 10% ethanol solution | 4.89 | ml |
| Distilled water to make | 1.36 | l |
| (R-1) | | |
| Thiourea dioxide | 26.6 | mg |
| Distilled water to make | 46.6 | ml |
| (T-1) | | |
| Sodium ethanethisulfonate | 879.9 | mg |
| Distilled water to make | 293.3 | ml |
| (F-1) | | |
| Fine grain emulsion comprised of 3 wt % gelatin and silver iodide grains (av. size of 0.05 μm) | 1097.1 | g |

The above emulsion was prepared in the following manner. To 5000 ml of a 6.0 wt.% gelatin solution containing 0.06 mol of potassium iodide, an aqueous solution containing 7.06 mol of silver nitrate and an aqueous solution containing 7.06 mol of potassium iodide, 2000 ml of each were added over a period of 10 min., while the pH was maintained at 2.0 using nitric acid and the temperature was maintained at 40° C. After completion of grain formation, the pH was adjusted to 6.0 using a sodium carbonate aqueous solution. The finished weight of the emulsion was 12.53 kg.

After completing grain growth, the emulsion was desalted according to the method described in JP-A 5-72658. Then, gelatin was further added thereto to redisperse the emulsion and the pH and pAg were adjusted to 5.80 and 8.06, respectively. The resulting emulsion was denoted as EM-1.

As a result of electronmicroscopic observation, it was proved that the resulting emulsion was comprised of tabular grains having an average diameter of 1.50 μm (average of equivalent circular diameter), tabular grains having an aspect ratio of 7.4 or more accounted for 70% of the total grain projected area, and a variation coefficient of grain diameter distribution was 14.5%.

Preparation of Emulsion EM-2 (Inventive)

Nucleation and Ripening Stage

The nucleation stage and the ripening stage were conducted in a manner similar to the preparation of emulsion EM-1.

Growth Stage

After completing the ripening stage, solutions (S-1) and (H-1) described above were added by the double jet addition at an accelerated flow rate (12 times faster at the end than at the start) for a period of 37 min. After completing addition, solution (R-1) was instantaneously added, followed by addition of solution (G-2) and the stirring speed was adjusted to 550 r.p.m., then, solution (S-3) and solution (H-3) were added by the double jet addition at an accelerated flow rate (1.4 times faster at the end than at the start) for a period of 20 min., while the silver potential of the emulsion was maintained at 6 mV with an aqueous 2N potassium bromide solution. After completing addition, the temperature within the reaction vessel was lowered to 40° C. in 15 min. Then, solution (Z-1) and subsequently, solution (SS) were added; the pH was adjusted to 9.3 with an aqueous potassium hydroxide solution and iodide ions were allowed to be released with ripening for 4 min. Thereafter, the pH was adjusted to 5.0 with an aqueous acetic solution and the silver potential was adjusted to −39 mv with an aqueous 3N potassium bromide solution. Subsequently, solutions (S-3) and (H-3) were added at an accelerated flow rate (1.5 times faster at the end than the start) for a period of 54 min., provided that when the remaining (S-3) solution reached 1.50 lit., solution (T-1) was further added instantaneously thereto.

| | | |
|---|---|---|
| (S-3) | | |
| Silver nitrate | 2.46 | kg |
| Distilled water to make | 4.14 | l |
| (H-3) | | |
| Potassium bromide | 1.73 | kg |
| Distilled water to make | 4.15 | l |
| (Z-1) | | |
| Sodium p-iodoacetoamido-benzenesulfonate | 224.5 | g |
| Distilled water to make | 2.69 | l |
| (SS) | | |
| Sodium sulfite | 78.0 | g |
| Distilled water | 0.31 | l |

After completing grain growth, the emulsion was desalted according to the method described in JP-A 5-72658. Then, gelatin was further added thereto to redisperse the emulsion and the pH and pAg were adjusted to 5.80 and 8.06, respectively. The resulting emulsion was denoted as EM-2.

As a result of electronmicroscopic observation, it was proved that the resulting emulsion was comprised of tabular grains having an average diameter of 1.52 μm (average of equivalent circular diameter), tabular grains having an aspect ratio of 7.4 or more accounted for 70% of the total grain projected area, and a variation coefficient of grain diameter distribution was 14.5%.

Preparation of Inventive Emulsion EM-3 (Inventive)

Nucleation and Ripening Stage

The nucleation stage and the ripening stage were conducted in a manner similar to the preparation of emulsion EM-1.

Growth Stage

After completing the ripening stage, solutions (S-1) and (H-1) described above were added by the double jet addition at an accelerated flow rate (12 times faster at the end than at the start) for a period of 37 min. After completing addition, solution (R-2) was instantaneously added, followed by addition of solution (G-2) and the stirring speed was adjusted to 550 r.p.m., then, solution (S-2) and solution (H-2) were added by the double jet addition at an accelerated flow rate (2 times faster at the end than at the start) for a period of 20 min., while the silver potential of the emulsion was maintained at 6 mV with an aqueous 2N potassium bromide solution. During addition, when the remaining solution (S-2) reached 3.33 l, solution (R-3) was instantaneously added thereto After completing addition, the silver potential was adjusted to −39 mV with an aqueous 3N potassium bromide solution. Subsequently, after adding solution (F-1) of 1097.1 g, solution (S-2) and (H-2) were added by the double jet addition at an accelerated flow rate (1.5 times faster at the end than at the start) for a period of 54 min. During addition, when the remaining amount of solution (s-2) reached 1.50 l, solution (T-1) was instantaneously added.

| | | |
|---|---|---|
| (R-2) | | |
| Thiourea dioxide | 6.65 | mg |
| Distilled water to make | 11.7 | ml |
| (R-3) | | |
| Thiourea dioxide | 8.87 | mg |
| Distilled water to make | 15.5 | ml |
| (R-4) | | |
| Thiourea dioxide | 11.1 | mg |
| Distilled water to make | 19.4 | ml |

After completing grain growth, the emulsion was desalted according to the method described in JP-A 5-72658. Then, gelatin was further added thereto to redisperse the emulsion and the pH and pAg were adjusted to 5.80 and 8.06, respectively. The resulting emulsion was denoted as EM-3.

As a result of electronmicroscopic observation, it was proved that the resulting emulsion was comprised of tabular grains having an average diameter of 1.53 μm (average of equivalent circular diameter), tabular grains having an aspect ratio of 7.5 or more accounted for 70% of the total grain projected area, and a variation coefficient of grain diameter distribution was 14.9%.

Preparation of Emulsion EM-4 (Comparative)

Emulsion EM-4 was prepared in a manner similar to emulsion EM-1, except that at the growth stage, instantaneous additions of solution (R-1) and solution (T-1) each were not conducted. The resulting emulsion was denoted as EM-4.

As a result of electronmicroscopic observation, it was proved that the resulting emulsion was comprised of tabular grains having an average diameter of 1.51 μm (average of equivalent circular diameter), tabular grains having an aspect ratio of 7.6 or more accounted for 60% of the total grain projected area, and a variation coefficient of grain diameter distribution was 14.9%.

Preparation of Emulsion EM-5 (Comparative)

Emulsion EM-5 was prepared in a manner similar to emulsion EM-1, except that during overall of the growth stage, the silver potential within the reaction vessel was maintained at 6 mV. The resulting emulsion was comprised of tabular grains having low aspect ratio and denoted as EM-5.

As a result of electronmicroscopic observation, it was proved that the resulting emulsion was comprised of tabular grains having an average diameter of 1.18 μm (average of equivalent circular diameter), tabular grains having an aspect ratio of 4.1 or more accounted for 60% of the total grain projected area, and a variation coefficient of grain diameter distribution was 15.6%.

Preparation of Emulsion EM-6 (Comparative)

Emulsion EM-4 was prepared in a manner similar to emulsion EM-1, except that during overall of the growth stage, the silver potential within the reaction vessel was maintained at −10 mV. The resulting emulsion was comprised of tabular grains having a large variation coefficient of grain size distribution and denoted as EM-6.

As a result of electronmicroscopic observation, it was proved that the resulting emulsion was comprised of tabular grains having an average diameter of 1.51 μm (average of equivalent circular diameter), tabular grains having an aspect ratio of 7.2 or more accounted for 60% of the total grain projected area, and a variation coefficient of grain diameter distribution was 26.3%.

Preparation of Emulsion EM-7 (Comparative)

Emulsion EM-4 was prepared in a manner similar to emulsion EM-1, except that when completing addition of solutions (S-2) and (H-3) at the growth stage, a fine silver bromide grain emulsion (av.grain size, 0.05 μm) was added and Ostwald ripening was conducted. The resulting emulsion was comprised of tabular grains containing low surface iodide and denoted as EM-7.

As a result of electronmicroscopic observation, it was proved that the resulting emulsion was comprised of tabular grains having an average diameter of 1.52 μm (average of equivalent circular diameter), tabular grains having an aspect ratio of 7.4 or more accounted for 60% of the total grain projected area, and a variation coefficient of grain diameter distribution was 15.5%.

Preparation of Emulsion EM-8 (Comparative)

Emulsion EM-8 was prepared in a manner similar to emulsion EM-1, except that during overall of the ripening stage, the pH within the reaction vessel was maintained at −10 mV. The resulting emulsion, denoted as EM-8, was comprised of tabular grains having no dislocation line in the central region of the major faces.

As a result of electronmicroscopic observation, it was proved that the resulting emulsion was comprised of tabular grains having an average diameter of 1.53 μm (average of equivalent circular diameter), tabular grains having an aspect ratio of 7.4 or more accounted for 60% of the total grain projected area, and a variation coefficient of grain diameter distribution was 15.7%.

Preparation of Emulsion EM-9 (Comparative)

Emulsion EM-9 was prepared in a manner similar to emulsion EM-1, except that solution (F-1) was not added at the growth stage. The resulting emulsion denoted as EM-9, was comprised of tabular grains having no dislocation line in the peripheral region of the major faces.

As a result of electronmicroscopic observation, it was proved that the resulting emulsion was comprised of tabular grains having an average diameter of 1.52 μm (average of equivalent circular diameter), tabular grains having an aspect ratio of 7.2 or more accounted for 60% of the total grain projected area, and a variation coefficient of grain diameter distribution was 15.4%.

Analytical results of Emulsions EM-1 to EM-9 with respect to composition, structure, etc. are summarized in Table 1.

TABLE 1

| Emulsion | Grain Size (μm) | Aspect ratio | V.C.*1 of Grain Size (%) | Av. Iodide (mol %) | Surface Iodide (mol %) | Av. Iodide/Surface Iodide |
|---|---|---|---|---|---|---|
| EM-1 | 1.50 | 7.5 | 14.5 | 3.5 | 7.4 | 2.14 |
| EM-2 | 1.52 | 7.4 | 14.6 | 3.5 | 7.5 | 2.11 |
| EM-3 | 1.53 | 7.5 | 14.9 | 3.5 | 7.3 | 2.09 |
| EM-4 | 1.51 | 7.6 | 14.7 | 3.5 | 7.4 | 2.11 |
| EM-5 | 1.18 | 4.1 | 15.6 | 3.5 | 7.0 | 2.00 |
| EM-6 | 1.51 | 7.2 | 26.3 | 3.5 | 7.1 | 2.03 |
| EM-7 | 1.52 | 7.4 | 15.5 | 3.5 | 2.4 | 0.69 |
| EM-8 | 1.53 | 7.4 | 15.7 | 3.5 | 7.2 | 2.06 |
| EM-9 | 1.53 | 7.2 | 15.4 | 3.5 | 7.3 | 2.09 |

| | Dislocation Line | | | | | Silver Nucleus | | Silver Chalcogenide Nucleus | | |
|---|---|---|---|---|---|---|---|---|---|---|
| Emulsion | Introduction (%)*2 | Central Region | Peripheral Region | No. in Peripheral Region | % by No.*3 | Vol (%)*4 | R (%)*5 | Vol (%)*4 | R (%)*5 | Remark |
| EM-1 | 50 | Yes | Yes | 70 | 80 | 18 | 56 | 70 | 89 | Inv. |
| EM-2 | 50 | Yes | Yes | 90 | 90 | 18 | 56 | 70 | 89 | Inv. |
| EM-3 | 50 | Yes | Yes | 70 | 80 | 18, 34, 50 | 56, 70, 79 | 70 | 89 | Inv. |
| EM-4 | 50 | Yes | Yes | 70 | 80 | — | — | — | — | Comp. |
| EM-5 | 50 | Yes | Yes | 40 | 50 | 18 | 56 | 70 | 89 | Comp. |
| EM-6 | 50 | Yes | Yes | 70 | 70 | 18 | 56 | 70 | 89 | Comp. |
| EM-7 | 50 | Yes | Yes | 60 | 65 | 18 | 56 | 70 | 89 | Comp. |
| EM-8 | — | No | Yes | 70 | 0 | 18 | 56 | 70 | 89 | Comp. |
| EM-9 | 50 | Yes | No | 0 | 0 | 18 | 56 | 70 | 89 | Comp. |

*1: Variation Coefficient of Grain Size Distribution
*2: Dislocation line-introduced location, based on the grain volume
*3: Percentage by number of tabular grains having dislocation lines in the central and peripheral regions of the major faces
*4: Location (%), based on the grain volume
*5: Location (%), based on the grain diameter

Example 2

Adding $6.5\times10^{-4}$ mol/mol Ag of sensitizing dye SD-9 and $2.5\times10^{-4}$ mol/mol Ag of sensitizing dye SD-10, emulsions EM-1 to EM-9 each were ripened at 55° C. for 15 min., and then were further ripened adding chemical sensitizers (sodium thiosulfate, chloroauric acid and potassium thiocyanate). The added amounts of the chemical sensitizers and the ripening time after adding the chemical sensitizers were adjusted for each emulsion so that optimum sensitivity-fog was obtained. After completing chemical sensitization, 10 mg/mol Ag of 1-phenyl-5-mercaptotetrazole and 500 mg/mol Ag of 4-hydroxy-6-methyl-1,3,3a,7-tetrazaindene were added to stabilize the emulsions.

Preparation of Photographic Material Sample 101

On a triacetyl cellulose film support were formed the following layers containing composition shown below to prepare a multi-layered color photographic material Sample 101.

The addition amount of each compound was represented in term of $g/m^2$, provided that the amount of silver halide or colloidal silver was converted to the silver amount and the amount of a sensitizing dye (denoted as "SD") was represented in mol/mol Ag.

| | |
|---|---|
| 1st Layer: Anti-Halation Layer | |
| Black colloidal silver | 0.16 |
| UV absorbent (UV - 1) | 0.3 |
| Colored magenta coupler (CM-1) | 0.123 |
| Colored cyan coupler (CC-1) | 0.044 |
| High boiling solvent (OIL - 1) | 0.167 |
| Gelatin | 1.33 |
| 2nd Layer: Intermediate Layer | |
| Anti-staining agent (AS-1) | 0.160 |
| High boiling solvent (OIL - 1) | 0.20 |
| Gelatin | 0.69 |
| 3rd Layer: Low-speed Red-Sensitive Layer | |
| Silver iodobromide emulsion a | 0.20 |
| Silver iodobromide emulsion b | 0.29 |
| SD - 1 | $2.37 \times 10^{-5}$ |
| SD - 2 | $1.2 \times 10^{-4}$ |
| SD - 3 | $2.4 \times 10^{-4}$ |
| SD - 4 | $2.4 \times 10^{-6}$ |
| C - 1 | 0.32 |
| CC-1 | 0.038 |
| OIL-2 | 0.28 |
| AS-2 | 0.002 |
| Gelatin | 0.73 |
| 4th Layer: Medium-speed Red-sensitive Layer | |
| Silver iodobromide emulsion c | 0.10 |
| Silver iodobromide emulsion d | 0.86 |
| SD-1 | $4.5 \times 10^{-5}$ |
| SD-2 | $2.3 \times 10^{-4}$ |
| SD-3 | $4.5 \times 10^{-4}$ |
| C-2 | 0.52 |
| CC-1 | 0.06 |
| DI-1 | 0.047 |
| OIL-2 | 0.46 |
| AS-2 | 0.004 |
| Gelatin | 1.30 |
| 5th Layer: High-speed Red-Sensitive Layer | |
| Silver iodobromide emulsion c | 0.13 |
| Silver iodobromide emulsion d | 1.18 |
| SD-1 | $3.0 \times 10^{-5}$ |
| SD-2 | $1.5 \times 10^{-4}$ |
| SD-3 | $3.0 \times 10^{-4}$ |
| C-2 | 0.047 |
| C-3 | 0.09 |
| CC-1 | 0.036 |
| DI-1 | 0.024 |
| OIL-2 | 0.27 |
| AS-2 | 0.006 |
| Gelatin | 1.28 |
| 6th Layer: Intermediate Layer | |
| OIL-1 | 0.29 |
| AS-1 | 0.23 |
| Gelatin | 1.00 |
| 7th Layer: Low-speed Green-Sensitive Layer | |
| Silver iodobromide emulsion a | 0.19 |
| Silver iodobromide emulsion b | 0.062 |
| SD-4 | $3.6 \times 10^{-4}$ |
| SD-5 | $3.6 \times 10^{-4}$ |
| M-1 | 0.18 |
| CM-1 | 0.033 |

-continued

| | |
|---|---|
| OIL-1 | 0.22 |
| AS-2 | 0.002 |
| AS-3 | 0.05 |
| Gelatin | 0.61 |
| 8th layer: Interlayer | |
| OIL-1 | 0.26 |
| AS-1 | 0.054 |
| Gelatin | 0.80 |
| 9th Layer: Medium-speed Green-Sensitive Layer | |
| Silver iodobromide emulsion e | 0.54 |
| Silver iodobromide emulsion f | 0.54 |
| SD-6 | $3.7 \times 10^{-4}$ |
| SD-7 | $7.4 \times 10^{-5}$ |
| SD-8 | $5.0 \times 10^{-5}$ |
| M-1 | 0.17 |
| M-2 | 0.33 |
| CM-1 | 0.024 |
| CM-2 | 0.029 |
| DI-2 | 0.024 |
| DI-3 | 0.005 |
| OIL-1 | 0.73 |
| AS-2 | 0.003 |
| AS-3 | 0.035 |
| Gelatin | 1.80 |
| 10th Layer: High-speed Green-Sensitive Layer | |
| Silver iodobromide emulsion f | 1.19 |
| SD-6 | $4.0 \times 10^{-4}$ |
| SD-7 | $8.0 \times 10^{-5}$ |
| SD-8 | $5.0 \times 10^{-5}$ |
| M-1 | 0.065 |
| CM-1 | 0.022 |
| CM-2 | 0.026 |
| DI-2 | 0.003 |
| DI-3 | 0.003 |
| OIL-1 | 0.19 |
| OIL-2 | 0.43 |
| AS-2 | 0.014 |
| AS-3 | 0.017 |
| Gelatin | 1.23 |
| 11th Layer: Yellow Filter Layer | |
| Yellow colloidal silver | 0.05 |
| OIL-1 | 0.18 |
| AS-1 | 0.16 |
| Gelatin | 1.00 |
| 12th Layer: Low-speed Blue-sensitive Layer | |
| Silver iodobromide emulsion g | 0.22 |
| Silver iodobromide emulsion a | 0.08 |
| Silver iodobromide emulsion h | 0.09 |
| SD-9 | $6.5 \times 10^{-4}$ |
| SD-10 | $2.5 \times 10^{-4}$ |
| Y-A | 0.77 |
| DI-4 | 0.017 |
| OIL-1 | 0.31 |
| AS-2 | 0.002 |
| Gelatin | 1.29 |
| 13th Layer: High-sped Blue-sensitive Layer | |
| Emulsion EM-1 | 1.02 |
| Y-A | 0.23 |
| OIL-1 | 0.10 |
| AS-2 | 0.004 |
| Gelatin | 1.20 |
| 14th Layer: First Protective Layer | |
| Silver iodobromide emulsion i | 0.30 |
| UV-1 | 0.055 |
| UV-2 | 0.110 |
| OIL-2 | 0.30 |
| Gelatin | 1.32 |

-continued

| 15th Layer: Second protective Layer | |
|---|---|
| PM-1 | 0.15 |
| PM-2 | 0.04 |
| WAX-1 | 0.02 |
| D-1 | 0.001 |
| Gelatin | 0.55 |

Characteristics of silver iodobromide emulsions described above are shown below, in which the average grain size refers to an edge length of a cube having the same volume as that of the grain.

TABLE 2

| Emulsion | Av. grain size (μm) | Av. AgI content (mol %) | Diameter/thickness ratio |
|---|---|---|---|
| a | 0.30 | 2.0 | 1.0 |
| b | 0.40 | 8.0 | 1.4 |
| c | 0.60 | 7.0 | 3.1 |
| d | 0.74 | 7.0 | 5.0 |
| e | 0.60 | 7.0 | 4.1 |
| f | 0.65 | 8.7 | 6.5 |

TABLE 2-continued

| Emulsion | Av. grain size (μm) | Av. AgI content (mol %) | Diameter/thickness ratio |
|---|---|---|---|
| g | 0.40 | 2.0 | 4.0 |
| h | 0.65 | 8.0 | 1.4 |
| i | 0.05 | 2.0 | 1.0 |

The silver iodobromide emulsions a to h each were added with above-described sensitizing dyes (denoted as "SD") and ripened, and then chemically sensitized by adding triphenylphosphine selenide, sodium thiosulfate, chloroauric acid and potassium thiocyanate until relationship between sensitivity and fog reached an optimum point.

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 1,100,000; inhibitors AF-3, AF-4 and AF-5; hardener H-1 and H-2; and antiseptic Ase-1.

Chemical formulas of compounds used in the Samples described above are shown below.

C-1

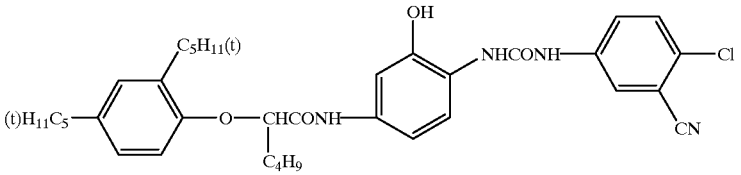

C-2

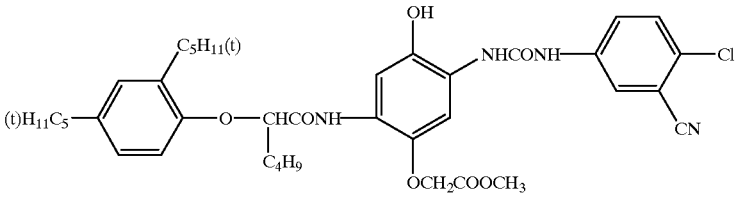

C-3

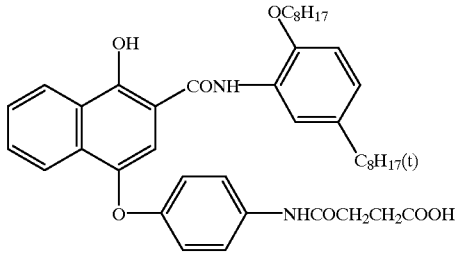

-continued
M-1
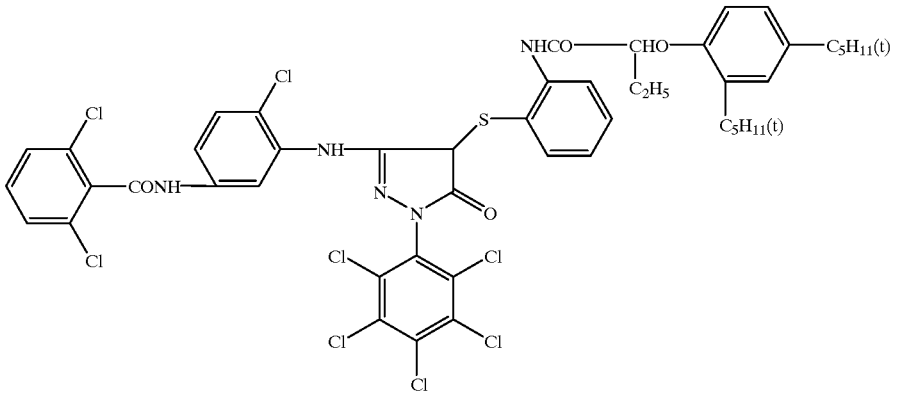
M-2
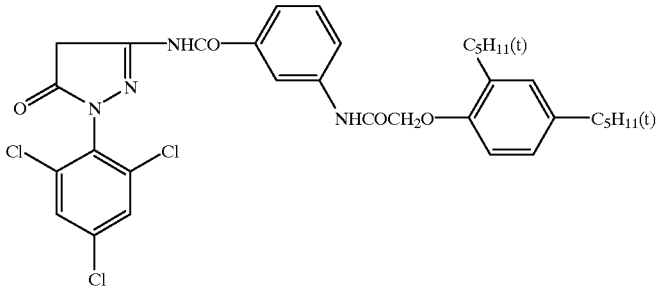
Y-A
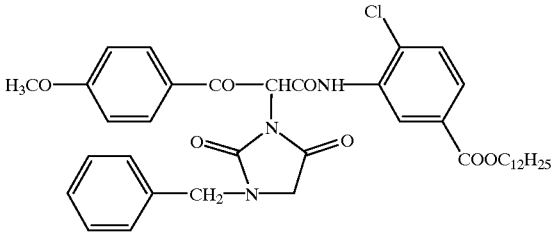
CC-1
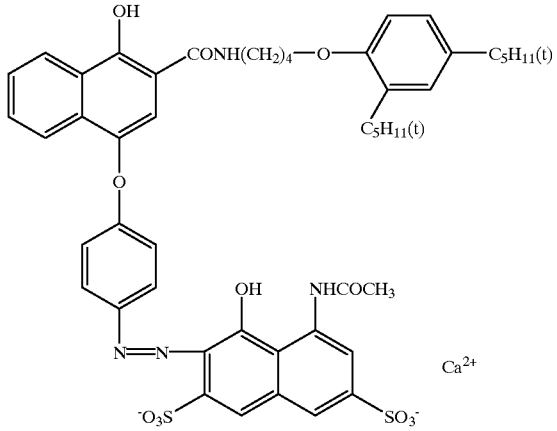

-continued
CM-1
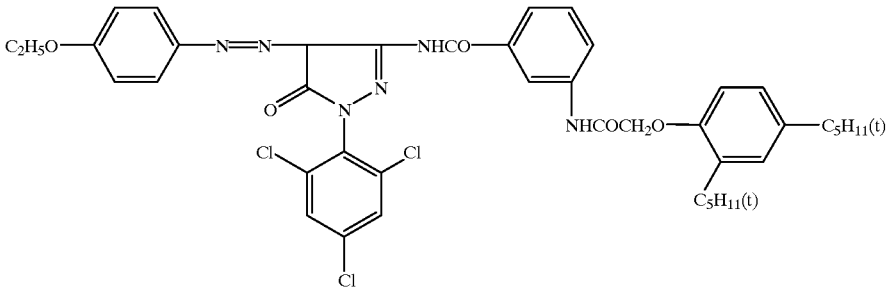
CM-2
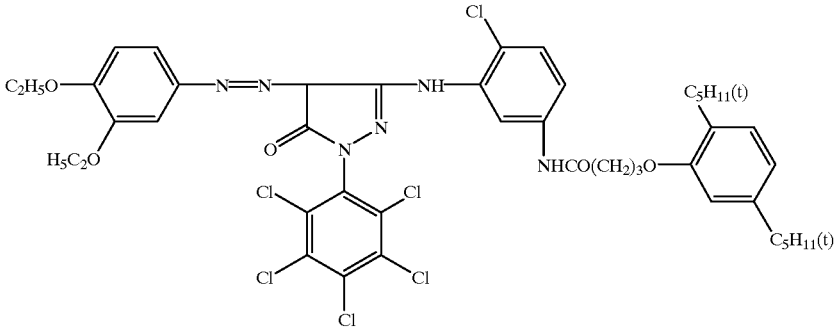
DI-1
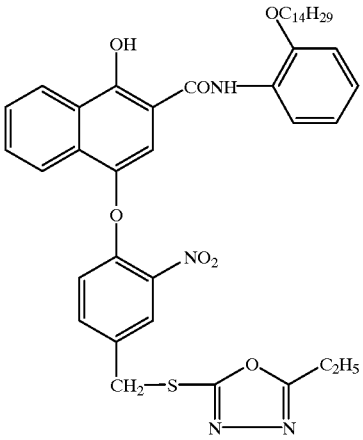
DI-2
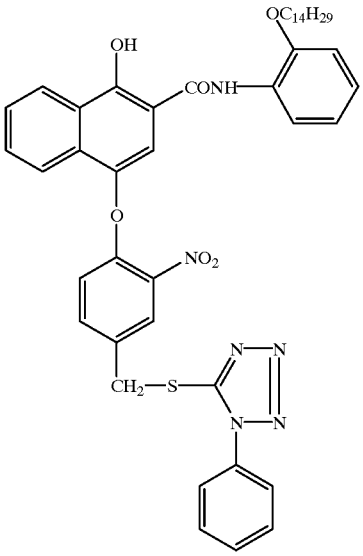

-continued
DI-3
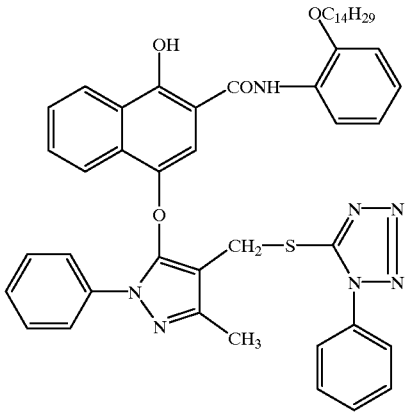
DI-4
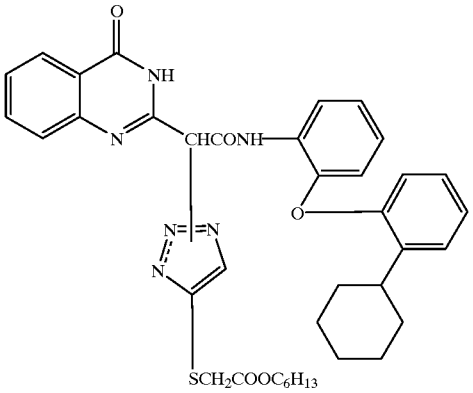
AS-1
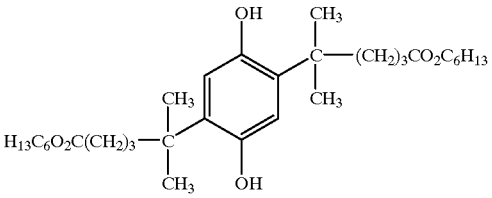
AS-2
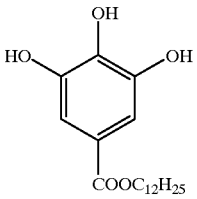
AS-3
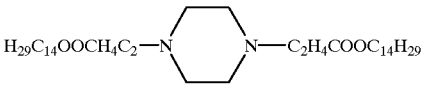
SD-1
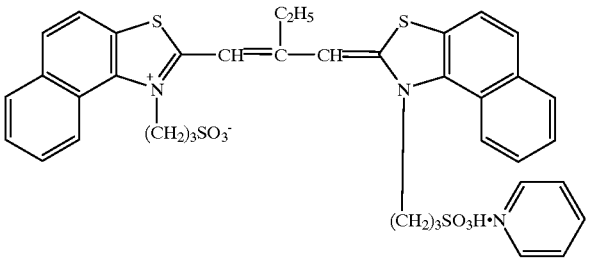

-continued
SD-2
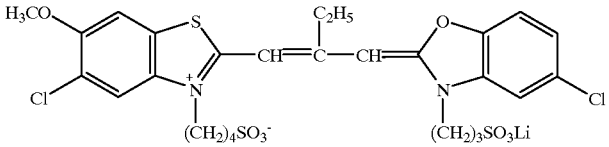
SD-3
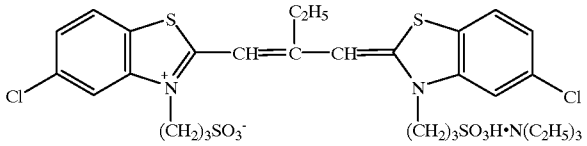
SD-4
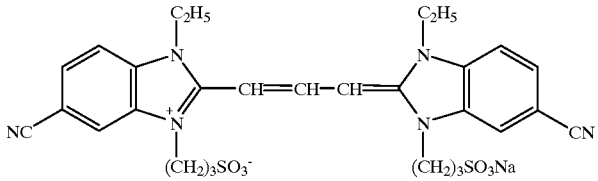
SD-5
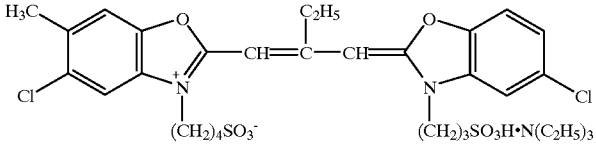
SD-6
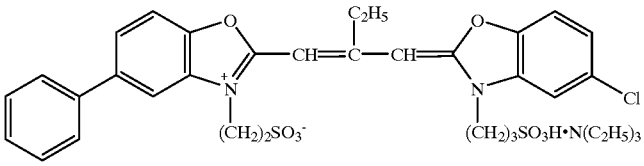
SD-7
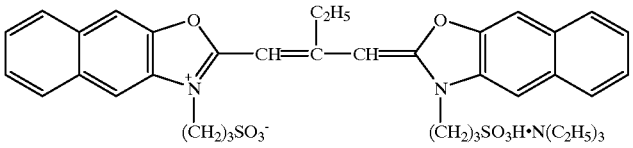
SD-8
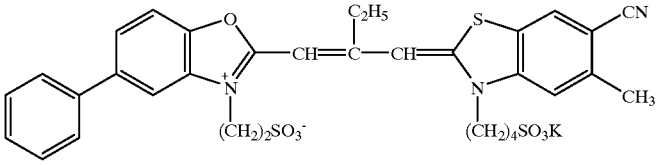
SD-9
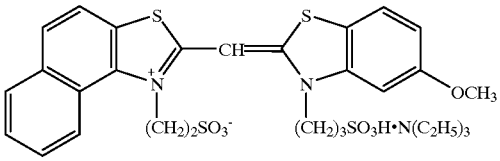
SD-10
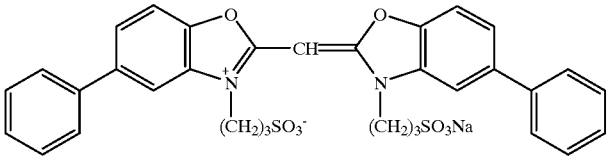

-continued
ST-1
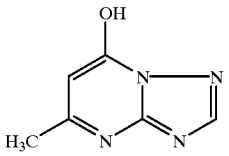
ST-2
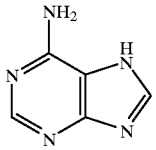
AF-1, 2
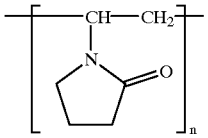
AF-1 Mw = 10,000
AF-2 Mw = 1,100,000
n: Polymerization degree
AF-3
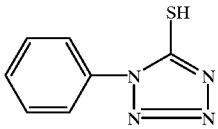
AF-4
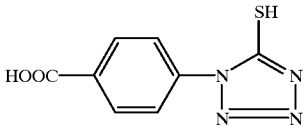
AF-5
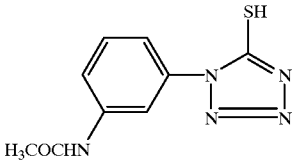
SU-1
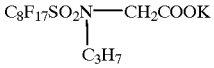
SU-2
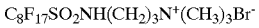
SU-3
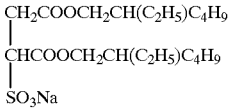
SU-4
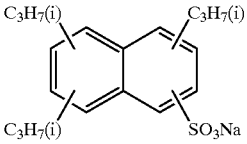
WAX-1
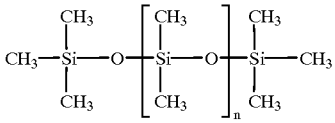
Mw = 3,000

-continued
D-1
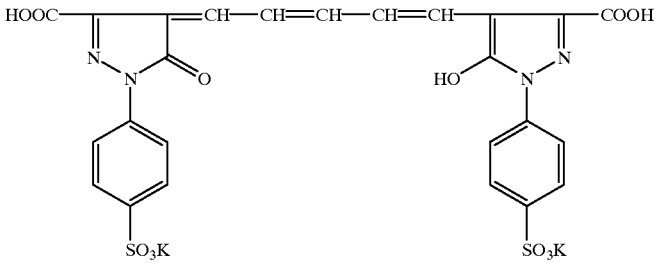
PM-1
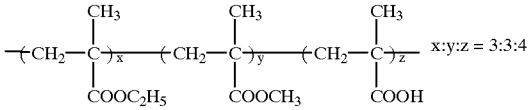
PM-2
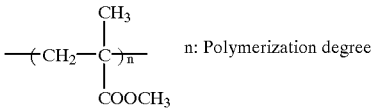
OIL -1
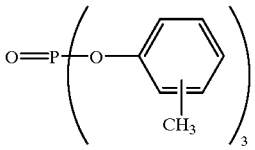
UV-1
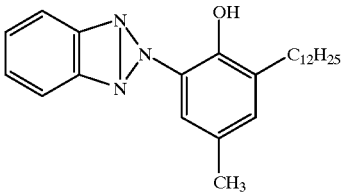
OIL-2
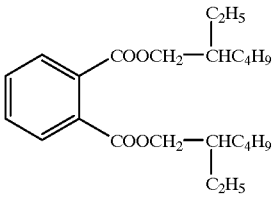
UV-2
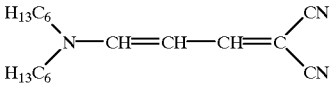
V-1
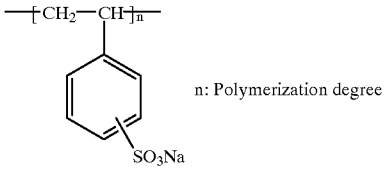
Ase-1(Mixture)
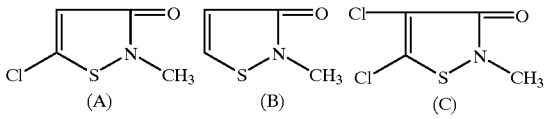
A:B:C = 50:46:4(molar ratio)
H-1
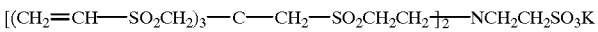

-continued

H-2

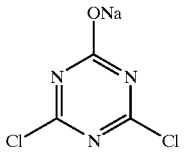

Preparation of Photographic material Samples 1–2 to 109

Photographic material Samples 102 to 109 were prepared in a manner similar to Sample 101, except that emulsion EM-1 used in the 13th layer was replaced by either of emulsions EM-2 to EM-9.

Samples 101 to 109 each were evaluated with respect to sensitivity of the blue-sensitive layer, latent image variation (storage under ordinary temperature and ordinary humidity and storage under hogh temperature and high humidity), aging fog variation, graininess, fogging by pressure and desensitization by pressure. Results thereof are shown in Table 3.

Evaluation of sensitivity

After exposed through an optical wedge, photographic material samples were kept in a refrigerator (−20° C.) until immediately before subjected to processing (Condition A) and processed according to the process shown below. Optical densities of the processed samples were measured with blue light. Exposure $[H_1]$ necessary to give a density of fog density plus 0.1 was determined. Sensitivity (A) was represented as a relative value of −log $[H_1]$, based on the sensitivity of Sample 101 being 100.

Evaluation of fog

With respect to fog, an optical density of unexportions was measured with blue light.

Variation of latent image (ord. temperature and ord. humidity)

After exposed through an optical wedge, photographic material samples were kept under conditions at a temperature of 25° C. and a relative humidity of 60% for 30 (Condition B) days and subjected to processing according to the process shown below. Optical densities of the processed samples were sensitometrically measured with blue light. Exposure $[H_2]$ necessary to give a density of fog density plus 0.1 was determined and sensitivity (B) was represented as −log $[H_2]$. From sensitivities (A) and (B), the value of [(B)−(A)]/(A) was calculated. Latent image variation (ordinary temperature and ordinary humidity) was represented by a relative value of the value of [(B)−(A)]/(A), based on the sensitivity (A) being 100.

Variation of latent image (high temperature and high humidity)

After exposed through an optical wedge, photographic material samples were kept under conditions at a temperature of 55° C. and a relative humidity of 80% for 3 days (Condition C) and subjected to processing according to the process shown below. Optical densities of the processed samples were sensitometorically measured with blue light. Exposure $[H_3]$ necessary to give a density of fog density plus 0.1 was determined and sensitivity (C) was represented as −log $[H_3]$. From sensitivities (A) and (C), the value of [(C)−(A)]/(A) was calculated. Latent image variation (ordinary temperature and ordinary humidity) was represented by a relative value of the value of [(B)−(A)]/(A), based on the sensitivity (A) being 100.

Evaluation of aging fog variation

After exposed through an optical wedge, photographic material samples were kept in a refrigerator (−20° C.) until being subjected to processing (Condition A) and processed according to the process shown below. Concurrently, another set of samples, after exposed, were kept under conditions at a temperature of 55° C. and a relative humidity of 60% for 20 days (Condition D) and subjected to processing. Optical densities of both sets of the processed samples were sensitometorically measured with blue light and aging fog was evaluated, based on an increase of fog between Conditions A and C. Aging fog is to be a measure of storage stability.

Evaluation of graininess

Photographic material samples were exposed through an optical wedge and processed according to the process as described below. The resulting processed samples each were scanned using a microdensitometer with an aperture area of 250 $\mu m^2$, with respect to the density of Dmin plus 0.3. to determine the standard deviation of variation of the blue light density (RMS value). Graininess was represented in terms of the RMS value and by a relative value thereof, based the RMS value of Sample 101 being 100. The less the RMS value, the better the graininess.

Evaluation pressure fogging

After contacting with a needle having a 0.025 mm curvature radius of the point, loaded with 5 g and moving at a constant speed using a scratch tester (available from Shinto Kagaku) at 23° C. and 55% RH, unexposed photographic material samples each were processed according to the process described below. The difference (ΔD1) in blue light minimum density (Dmin) between loaded and unloaded portions was determined. Pressure fogging was represented in terms of ΔD1 and shown as a relative value, based on the ΔD1 of Sample 101 being 100.

Evaluation of pressure desensitization

After contacting with a needle having a 0.025 mm curvature radius of the point, loaded with 5 g and moving at a constant speed using a scratch tester (available from Shinto Kagaku) at 23° C. and 55% RH, unexposed photographic material samples each were processed according to the process described below. The difference (ΔD2) in blue light density of Dmin plus 0.3 (Dmin+0.3) between loaded and unloaded portions was determined. Pressure desensitization was represented in terms of ΔD2 and shown as a relative value, based on the ΔD2 of Sample 101 being 100.

Processing:

| Processing step | Time | Temperature | Replenishing rate* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 1 min. | 38 ± 5.0° C. | 830 ml |
| Drying | 1 min. | 55 ± 5.0° C. | — |

*: Amounts per $m^2$ of photographic material

A color developer, bleach, fixer and stabilizer each were prepared according to the following formulas. Color developer and replenisher thereof:

| | Worker | Replenisher |
|---|---|---|
| Water | 800 ml | 800 ml |
| Potassium carbonate | 30 g | 35 g |
| Sodium hydrogencarbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| Sodium chloride | 0.6 g | — |
| 4-Amino-3-methyl-N-(β-hydroxyethyl)-aniline sulfate | 4.5 g | 6.3 g |
| Diethylenetriaminepentaacetic acid | 3.0 g | 3.0 g |
| Potassium hydroxide | 1.2 g | 2.0 g |

Water was added to make 1 liter in total, and the pH of the developer and its replenisher were each adjusted to 10.06 and 10.18, respectively with potassium hydroxide and sulfuric acid.

Bleach and replenisher thereof:

| | Worker | Replenisher |
|---|---|---|
| Water | 700 ml | 700 ml |
| Ammonium iron (III) 1,3-diamino-propanetetraacetic acid | 125 g | 175 g |
| Ethylenediaminetetraacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter in total and the pH of the bleach and replenisher thereof were adjusted to 4.4 and 4.0, respectively, with ammoniacal water or glacial acetic acid.

Fixer and replenisher thereof:

| | Worker | Replenisher |
|---|---|---|
| Water | 800 ml | 800 ml |
| Ammonium thiocyanate | 120 g | 150 g |
| Ammonium thiosulfate | 150 g | 180 g |
| Sodium sulfite | 15 g | 20 g |
| Ethylenediaminetetraacetic acid | 2 g | 2 g |

Water was added to make 1 liter in total and the pH of the fixer and replenisher thereof were adjusted to 6.2 and 6.5, respectively, with ammoniacal water or glacial acetic acid.

Stabilizer and replenisher thereof:

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

TABLE 3

| Sample | Emulsion | Sensitivity (A) | Fog | Latent Image Variation: Ord. Temp. & Humidity | Latent Image Variation: High Temp. & Humidity | Aging Fog Variation | Graininess | Pressure Resitance: $\Delta D_1$ | Pressure Resitance: $\Delta D_2$ | |
|---|---|---|---|---|---|---|---|---|---|---|
| 101 | EM-1 | 100 | 0.17 | −2 | −2 | +0.02 | 100 | 100 | 100 | Inv. |
| 102 | EM-2 | 130 | 0.18 | −2 | −1 | +0.02 | 103 | 99 | 98 | Inv. |
| 103 | EM-3 | 115 | 0.16 | −1 | −1 | +0.01 | 100 | 95 | 95 | Inv. |
| 104 | EM-4 | 90 | 0.28 | −25 | −17 | +0.08 | 100 | 105 | 110 | Comp. |
| 105 | EM-5 | 55 | 0.25 | −5 | −18 | +0.05 | 100 | 100 | 125 | Comp. |
| 106 | EM-6 | 70 | 0.19 | −3 | −2 | +0.03 | 150 | 105 | 105 | Comp. |
| 107 | EM-7 | 95 | 0.18 | −3 | −3 | +0.04 | 180 | 105 | 110 | Comp. |
| 108 | EM-8 | 98 | 0.18 | −3 | −4 | +0.04 | 100 | 104 | 200 | Comp. |
| 109 | EM-9 | 95 | 0.18 | −4 | −4 | +0.03 | 100 | 120 | 120 | Comp. |

As can be seen from the results of Table 3, samples 101 to 103 each containing an emulsion according to the invention exhibited enhanced sensitivity and improvements in graininess, latent image stability and pressure characteristics. Specifically, sample 103 containing emulsion EM-3 exhibited superior results.

What is claimed is:

1. A silver halide emulsion comprising a dispersing medium and silver halide grains having a variation coefficient of grain size distribution of not more than 20%, at least 50% of total grain projected area of the emulsion being accounted for by tabular grains having major faces and an aspect ratio of at least 5, said tabular grains (a) each having a surface region having an iodide content more than an average iodide content of the silver halide grains, (b) at least 30% by number of the tabular grains having dislocation lines in a central region and a peripheral region of the major faces, (c) the peripheral region having at least a silver chalcogenide nucleus-containing phase, (d) the central region having at least a silver nucleus-containing phase, and (e) the peripheral region having at least 10 dislocation lines per grain.

2. The silver halide emulsion of claim 1, wherein the variation coefficient is not more than 16%.

3. The silver halide emulsion of claim 1, wherein said surface region has an iodide content of not less than 1 mol %.

4. The silver halide emulsion of claim 1, wherein the ratio of the iodide content of the surface region to the average iodide content of the silver halide grains is from 1.1 to 30.

5. The silver halide emulsion of claim 1, wherein said silver chalcogenide nucleus comprises silver sulfide, silver selenide or silver telluride.

6. The silver halide emulsion of claim 5, wherein said silver chalcogenide nucleus comprises silver sulfide.

7. The silver halide emulsion of claim 1, wherein said silver chalcogenide is formed using a thiosulfonic compound.

8. The silver halide emulsion of claim 1, wherein the central region has at least two silver nucleus-containing phases.

9. The silver halide emulsion of claim 1, wherein the peripheral region has at least 20 dislocation lines per grain.

10. A silver halide emulsion comprising a dispersing medium and silver halide grains, at least 50% of total grain projected area of the emulsion being accounted for by tabular grains having major faces and an aspect ratio of at least 5, said tabular grains (a) having a variation coefficient of grain size distribution of not more than 20%, (b) each having a surface region having an iodide content more than an average iodide content of the silver halide grains, (c) at least 30% by number of the tabular grains having dislocation lines in a central region and a peripheral region of the major faces, (d) the peripheral region having at least a silver chalcogenide nucleus-containing phase, (e) the central region having at least a silver nucleus-containing phase, and (f) the peripheral region having at least 10 dislocation lines per grain.

11. The silver halide emulsion of claim 10, wherein said surface region has an iodide content of not less than 1 mol %.

12. The silver halide emulsion of claim 10, wherein the ratio of the iodide content of the surface region to the average iodide content of the silver halide grains is from 1.1 to 30.

13. The silver halide emulsion of claim 12, wherein said silver chalcogenide nucleus comprises silver sulfide.

14. The silver halide emulsion of claim 10, wherein the central region has at least two silver nucleus-containing phases.

15. The silver halide emulsion of claim 10, wherein the peripheral region has at least 20 dislocation lines per grain.

16. A silver halide emulsion comprising a dispersing medium and silver halide grains, a variation coefficient of grain size distribution of total silver halide grains in the emulsion being not more than 20% and at least 50% of the projected area of total grains being accounted for by tabular grains having major faces and an aspect ratio of at least 5, wherein the tabular grains has a surface region having an iodide content higher than an average iodide content of the silver halide grains; at least 30% by number of the tabular grains having dislocation lines in a central region and a peripheral region of the major faces; the tabular grains having a silver chalcogenide nucleus containing phase in a portion outside the portion in which the dislocation lines of the peripheral region are introduced, and having a silver nucleus containing phase in a portion inside the portion in which the dislocation lines of the peripheral region are introduced; and the peripheral region further having at least 10 dislocation lines per grain.

17. A method of preparing a silver halide emulsion comprising a dispersing medium and silver halide grains having a variation coefficient of grain size distribution of not more than 20%, at least 50% of total grain projected area of the emulsion being accounted for by tabular grains having major faces and an aspect ratio of at least 5, said tabular grains (a) each having a surface region having an iodide content more than an average iodide content of the silver halide grains, (b) at least 30% by number of the tabular grains having dislocation lines in a central region and a peripheral region of the major faces, (c) the peripheral region having a silver chalcogenide nucleus-containing phase, (d) the central region having silver nucleus-containing phase, and (e) the peripheral region further having at least 10 dislocation lines per grain, the method comprising the steps of:

(i) forming nuclear grains by adding a silver salt and a halide salt to a mother liquor, (ii) ripening the nuclear grains, and (iii) growing the nuclear grains to form final grains by adding a silver salt and a halide salt.

18. The method of claim 17, wherein in step (iii), reduction sensitization is conducted, before reaching 64% of the ultimate volume of the grain, by adding a reducing agent or by ripening at a pAg of not more than 7.0 or at a pH of not less than 7.0.

19. The method of claim 17, wherein in step (iii), a compound capable of releasing a chalcogen ion is added at a time after reaching 64% of the ultimate volume of the grain and before completing addition of silver and halide salts.

20. The method of claim 19, wherein said compound capable of releasing a chalcogen ion is a thiosulfonic acid compound represented by the following formulas (1) to (3):

$$R—SO_2S—M \quad (1)$$

$$R—SO_2S—R_1 \quad (2)$$

$$RSO_2S—Lm—SSO_2—R_2 \quad (3)$$

wherein R, $R_1$ and $R_2$ independently represent an aliphatic group, an aromatic group or a heterocyclic group; M represents a cation; L represents a bivalent linkage group; and m is 0 or 1.

21. The method of claim 17, wherein in step (ii), ripening is conducted at a pH of 7.0 to 10.0 and a temperature of 40 to 80° C.

22. The method of claim 17, wherein in step (iii), fine silver iodide grains or an iodide ion releasing agent is added at a time after reaching 64% of the ultimate volume of the grain and before completing addition of silver and halide salts.

23. The method of claim 22, wherein after adding the fine silver iodide grains or iodide ion releasing agent, a compound capable of releasing a chalcogen ion is added at a time after reaching 64% of the ultimate volume of the grain and before completing addition of silver and halide salts.

24. A silver halide light sensitive photographic material comprising a support having thereon a silver halide emulsion layer, wherein said silver halide emulsion layer comprises silver halide grains having a variation coefficient of grain size distribution of not more than 20%, at least 50% of total grain projected area of the emulsion being accounted for by tabular grains having major faces and an aspect ratio of at least 5, said tabular grains (a) each having a surface region having an iodide content more than an average iodide content of the silver halide grains, (b) at least 30% by number of the tabular grains having dislocation lines in a central region and a peripheral region of the major faces, (c) the peripheral region having at least a silver chalcogenide nucleus-containing phase, (d) the central region having at least a silver nucleus-containing phase, and (e) the peripheral region further having at least 10 dislocation lines per grain.

* * * * *